US006000179A

United States Patent [19]

Musculus et al.

[11] Patent Number: 6,000,179

[45] Date of Patent: Dec. 14, 1999

[54] STACKING PANEL AND OFF-MODULE PANEL CONNECTIONS

[75] Inventors: Jeffrey A. Musculus, Hastings; Robert E. Jeffers, Ada, both of Mich.; Peter S. Macdonald, Palo Alto, Calif.

[73] Assignee: Steelcase Inc., Grand Rapids, Mich.

[21] Appl. No.: 08/970,248

[22] Filed: Nov. 13, 1997

Related U.S. Application Data

[63] Continuation of application No. 08/766,673, Dec. 13, 1996.

[51] Int. Cl.[6] ..... E04B 2/74

[52] U.S. Cl. ..... 52/239; 52/36.6; 52/126.4; 52/243; 52/271; 52/489.1; 52/592.6; 52/656.9; 52/745.1; 52/747.1; 403/231; 403/375

[58] Field of Search ..... 52/36.6, 126.4, 52/239, 243, 271, 489.1, 592.6, 656.9, 745.1, 747.1; 403/231, 375

[56] References Cited

U.S. PATENT DOCUMENTS

| | | |
|---|---|---|
| 3,425,568 | 2/1969 | Albright . |
| 3,514,883 | 6/1970 | Albright . |
| 3,591,993 | 7/1971 | Reeves . |
| 3,700,385 | 10/1972 | Sherwood . |
| 4,370,838 | 2/1983 | Vermillion . |
| 4,567,698 | 2/1986 | Morrison . |
| 4,619,486 | 10/1986 | Hannah et al. . |
| 4,667,450 | 5/1987 | Stefnik et al. . |
| 4,712,336 | 12/1987 | Backer . |
| 4,716,699 | 1/1988 | Crossman et al. . |
| 4,821,477 | 4/1989 | Rydqvist . |
| 4,876,835 | 10/1989 | Kelley et al. . |
| 4,883,330 | 11/1989 | Armstrong et al. . |
| 4,905,334 | 3/1990 | Oppenhuizen ..... 52/656.1 X |
| 4,907,384 | 3/1990 | Underwood . |
| 4,914,878 | 4/1990 | Tamaki et al. . |

(List continued on next page.)

FOREIGN PATENT DOCUMENTS

| | | |
|---|---|---|
| 581818 | 3/1989 | Australia . |
| 0241344 | 10/1987 | European Pat. Off. . |
| 2118097 | 7/1972 | France . |
| 2579879 | 10/1986 | France . |
| 1098851 | 1/1968 | United Kingdom . |

OTHER PUBLICATIONS

Exhibit A discloses a freestanding partition system installed in a public area by Steelcase more than one year prior to the present filing date of Jul. 26, 1996 (3 pages).

Exhibit A is a brochure entitled *Knoll–Hannah Desk System*, 18 pages, dated Oct. 1986.

Exhibit B is a brochure entitled *Knoll–Hannah Desk System*, 13 pages, undated but published in 1986.

Exhibit C is a publication entitled *Knoll–Hannah Desk System—Electrical Assembly Guide*, (12 pages), undated but published in 1986.

Exhibit D is a publication entitled *Knoll–Hannah Desk System—Assembly Guide*, 12 pages, undated but published in 1986.

*Primary Examiner*—Christopher T. Kent

*Attorney, Agent, or Firm*—Price, Heneveld, Cooper, Dewitt & Litton

[57] ABSTRACT

A partition construction is provided for subdividing a building workspace wherein a first panel has a first frame with a horizontal top frame member and a vertical first side frame member, a second panel has a second frame with a horizontal bottom frame member and a vertical second side frame member, and a connection system for connecting the first and second panels in a stacked arrangement to form a first partition stack. The connection system includes at least one stacking connector which has fastener apertures proximate to each end of the connector. The fastener apertures in the stacking connector are in a predefined pattern identical to the fastener aperture pattern in the first and second side frame members. The connection system also includes a horizontal rail adapted to vertically align the top frame member of the first panel and bottom frame member of the second panel.

36 Claims, 7 Drawing Sheets

U.S. PATENT DOCUMENTS 4,944,122 7/1990 Wendt .
4,949,519 8/1990 Jeffers .
4,996,811 3/1991 Dull et al. .
5,003,740 4/1991 Dull et al. .
5,010,702 4/1991 Daw et al. .
5,024,030 6/1991 Morrison .
5,056,577 10/1991 DeLong et al. .
5,067,294 11/1991 McGowan .
5,069,263 12/1991 Edwards ..... 52/239 X
5,172,530 12/1992 Fishel et al. .
5,187,908 2/1993 Losensky .
5,197,256 3/1993 Martin .
5,309,686 5/1994 Underwood et al. .
5,377,466 1/1995 Insalaco et al. .
5,394,668 3/1995 Lim .
5,414,971 5/1995 Handte .
5,430,984 7/1995 Young et al. ..... 52/239 X
5,444,955 8/1995 Ou .
5,561,960 10/1996 Minnick et al. ..... 52/239 X
5,566,523 10/1996 Ozanne .
5,579,621 12/1996 Fang ..... 52/656.9 X 170
180
180
188
182
182
192
40
40
104
64
192
112
178
183
172
184
176
160
160
164
XXIII
XXIII
154
160
164
154
156
162
162
164

STACKING PANEL AND OFF-MODULE PANEL CONNECTIONS

This is a continuation of copending application Ser. No. 08/766,673 filed on Dec. 13, 1996.

BACKGROUND OF THE INVENTION

The present invention relates to partition arrangements for open office spaces and the like, and particular, to a free-standing portable panel and related partition system. Portable partition systems for open office spaces, and other similar settings, are well known in the art. Individual partition panels are interconnected in different configurations to form separate offices, work stations, or work settings. Partition panels are extremely durable, and can be readily disassembled and reassembled into alternative configurations to meet the ever-changing needs of the user. Examples of such partition systems are provided in U.S. Pat. Nos. 3,822,146; 3,831,330; and 4,144,924, which are owned by Steelcase Inc., the assignee of the present application.

The finishing or fitting-out of building spaces for offices, medical treatment facilities, and other similar environments has become a very important aspect of the effective space planning and layout. Work patterns, technology, and business organizations are constantly evolving and changing. The building space users require products which facilitate change at lower costs. Space planning is no longer a static problem. Changing technology and changing work processes demand that a design and installation be able to support and anticipate change.

There is presently an over supply of office space and furniture system which do not properly respond to or support change. Many older buildings do not have adequate utility capabilities, and the cost of conventional renovations or improvements often renders the same impractical. Even relatively new buildings can be quickly rendered obsolete by the fast paced changes in modern technology.

Consequently, a fully integrated prefabricated furnishing system has been developed to finish or fit-out both new and existing open plan building spaces. One requirement of this integrated furnishing system is a freestanding portable partition system having the capability for interconnecting partitions along the entire length of the partition as opposed to only interconnecting at partition ends.

Another desired aspect of the present integrated furnishing system is to provide a panel connection system having increased flexibility for interconnecting reconfigurable partition panels and office layouts. For example, a panel connection system is desired that allows use of standardized base panels even where the dimensions of the office layouts are not multiples of the base panel width dimension. Additional functionality of the connection system is also desired, such as to permit removing a partition panel from the middle of an in-line wall construction without progressive disassembly of in-line connected partition panels in the wall construction from an unconnected end of the wall construction, and such as to permit some wall sections to be constructed with a non-uniform or increased height.

Portions of such an office partitioning system may be comprised of relatively thick walls, thereby permitting the routing of the large number of electrical cables and data signal wires to provide an integrated office setting. However, the thicker walls are not always desirable in constructing individual office cubicles. Thus, a thin wall partition system is desirable which also possesses the same modular characteristics of the thicker wall system. Also, in office settings where a thicker wall is not desired, the thin wall should have the capability of being assembled in a fashion to create the desired walls, partitions, and office settings desired by the user.

Thus, a wall construction solving the aforementioned problems and providing the aforementioned functionality is desired.

SUMMARY OF THE INVENTION

One aspect of the present invention is a partition construction for subdividing a building workspace wherein a first panel has a first frame with a horizontal top frame member and a vertical first side frame member, a second panel had a second frame with a horizontal bottom frame member and a vertical second side frame member, and a connection system for connecting the first and second panels in a stacked arrangement to form a first partition stack. The connection system includes at least one stacking connector having fastener apertures proximate to each end of the connector. The fastener apertures in the stacking connector are in a predefined pattern identical to the fastener aperture pattern in the first and second side frame members. The connection system also includes a horizontal rail adapted to vertically align the top frame member of the first panel and bottom frame member of the second panel. In one form, the horizontal rail is disposed within a channel formed by the top and bottom frame members, and the rail has a plurality of slots therealong to facilitate the addition of a third panel at right angles thereto and intermediate the ends of the first and second panels.

Another aspect of the present invention is a partition construction including a plurality of substantially identically panels which are interconnectable in a stacked arrangement, in an in-line arrangement, or in a combined stacked and in-line arrangement. Each of the panels has a rectilinear frame wherein the frame has a horizontal top frame member, a horizontal bottom frame member, and vertical side frame members which maintain the top and bottom frame members in a parallel spaced apart relationship. The frame members define a central cavity and have a predefined pattern of fastener apertures therethrough. Also included in the partition construction are a plurality of horizontal rails, each of which is positioned proximate to a top frame member of each panel. Each of the horizontal rails has a repeating pattern of horizontally aligned slots therealong. At least one stacking connector is included for vertical stacking of the panels, the stacking connector having proximate to each end, fastener apertures in a predefined pattern substantially identical to the pattern of fastener apertures in the frame. At least one horizontal connector rail is used for connecting the panels in an in-line arrangement where the connector rail has proximate to each end thereof fastener apertures in a predefined pattern substantially identical to a portion of the fastener aperture pattern of the frame members.

Another aspect of the present invention is an off-module connector for connecting office partition panels in a substantial perpendicular fashion wherein a first partition panel is positioned intermediate the ends of a second partition panel at any of a predefined discrete regular positions therealong. The off-module connector includes an off modular connector rail having two sides and a web connecting the two sides and each of the sides have a plurality of horizontally oriented slots spaced at regular intervals and at least a first connector plate nested between the two sides and abutting the web. The connector plate has a first tab for engaging at least one of the slots in one side of the connector rail and a first hook member for engaging an end of a slot in the top edge of a partition panel to which the first partition panel is to be connected.

Yet another aspect of the invention is a method of connecting a first partition panel to a second partition panel intermediate the ends of the second partition panel where each of the panels has a plurality of in-line slots positioned at a top edge of each panel and where the top panel edges also define a channel therebetween. The method includes the steps of selecting a desired position for the first partition panel intermediate the ends of the second partition panel. A tab of a first off-module connector plate is engaged in a side slot in one side of an off-module connector rail, and the connector plate is abutted to a web of the off-module connector rail. A tab of a second off-module connector plate is engaged in an oppositely orientated side slot in the other side of the off-module connector rail and the connector plate is abutted to the first off-module connector plate. The first and second off-module connector plates are fastened to the web of the off-module connector rail. A first hook member of the first off-module connector plate is engaged in an end of one of the slots in the top edge of the second partition panel and a second hook member of a second off-module connector plate is engaged in the other end of the slot in the top edge of the second partition panel. The first partition panel is positioned intermediate the second partition panel and the off-module connector rail is fastened to the top of the first partition panel.

The principle objects of the present invention are to provide a freestanding portable partition panel and related system that has enhanced reconfigurability and the ability to be configured in a manner such that branch panels may be attached to a primary partition at any of a discrete number of regularly spaced intervals along the primary partition. The partition system enables developers and businesses to facilitate change and create lower cost environments to support new work processes even in outdated or under-utilized buildings. The partition system allows user control over environment, so as to create healthier work areas, which reduces stress and absenteeism. The partition system provides a new range of design options and allows a full range of levels of privacy. The partition system is efficient to use, economical to manufacture, with a long operating life, and particularly well adapted for the proposed use.

These and other objects, advantages and features of the present invention will become apparent upon review of the following specification in conjunction with the drawings.

DETAILED DESCRIPTION OF THE PREFERRED EMBODIMENT

Figure 1:
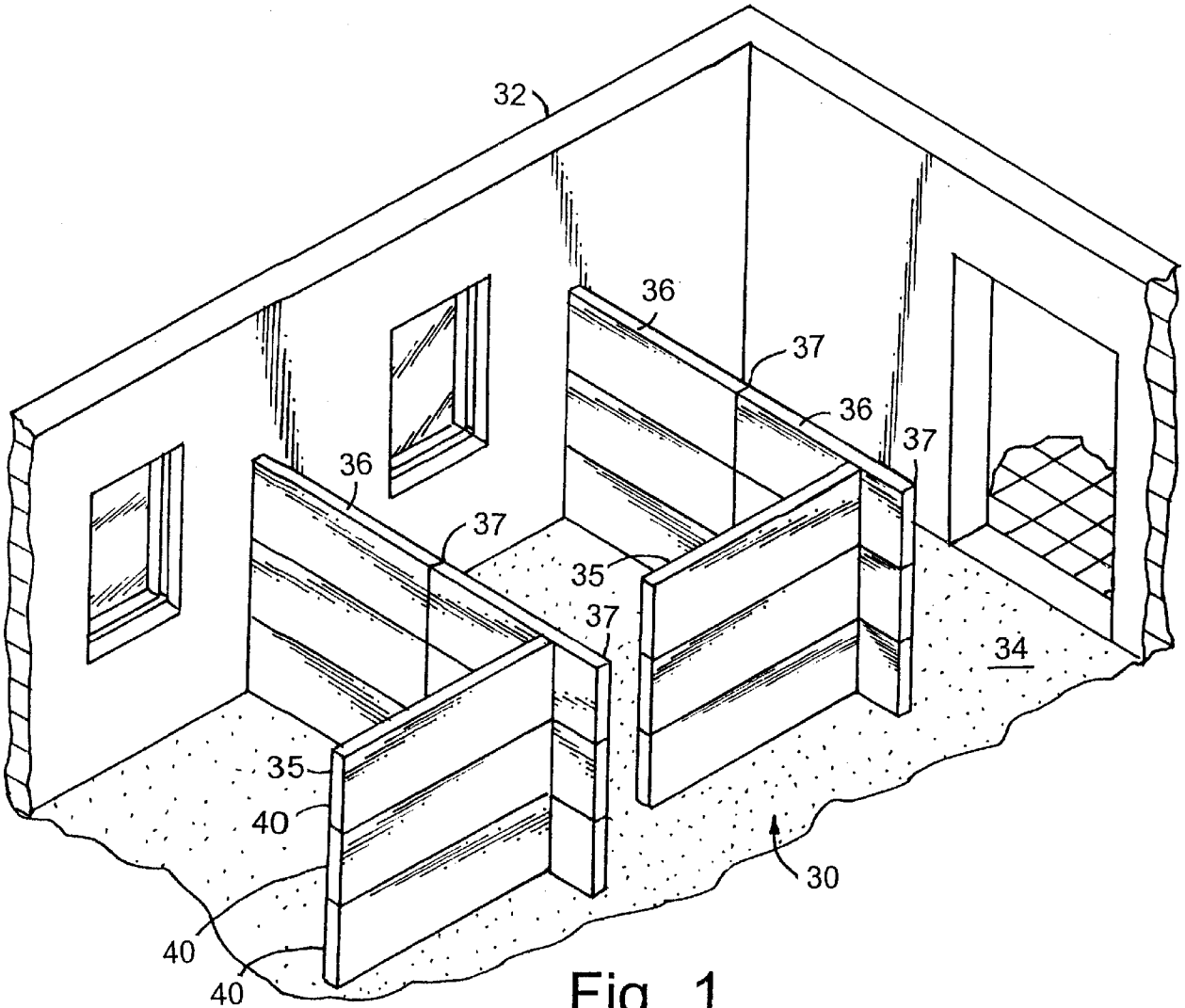
FIG. 1 is a perspective view of a portion of a building room in which a plurality of partition panels are arranged to form cubicles and where at least some of the panels are connected intermediate the ends of other panels.
Figure 14:
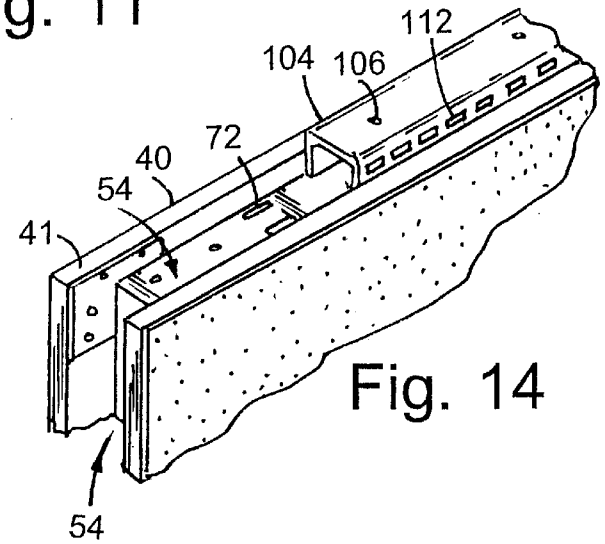
FIG. 14 is a perspective view of a horizontal rail disposed in the channel at a top edge of the partition panel.

For purposes of description herein, the terms "upper," "lower," "right," "left," "rear," "front," "vertical," "horizontal," and derivatives thereof shall relate to the invention as oriented in FIGS. 1 and 14. However, it is to be understood that the invention may assume various alternative orientations and step sequences except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting unless the claims expressly state otherwise.

Turning to the drawings, FIG. 1 shows a partition system 30 according to the present invention installed in an open area of building 32 wherein partition system 30 comprises a plurality of partition stacks 36 which are supported on a floor surface 34. Partition stacks 36 are, in turn, comprised of a plurality of partition panels 40 which may be adjoined to other partition stacks 36 at substantially right angles and intermediate ends 37 of partition stacks 36.

Figure 20:
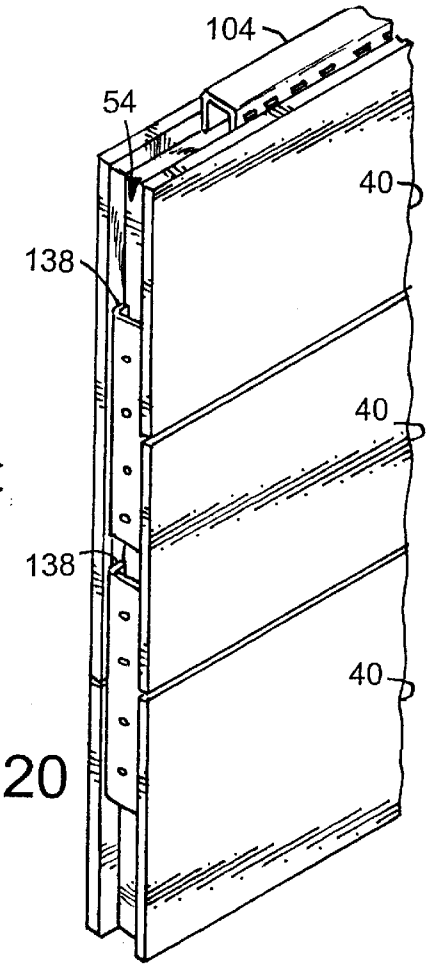
FIG. 20 is a perspective view of an end portion of a partition stack showing the stacking connectors vertically interconnecting partition panels into a partition stack.
Figure 24:
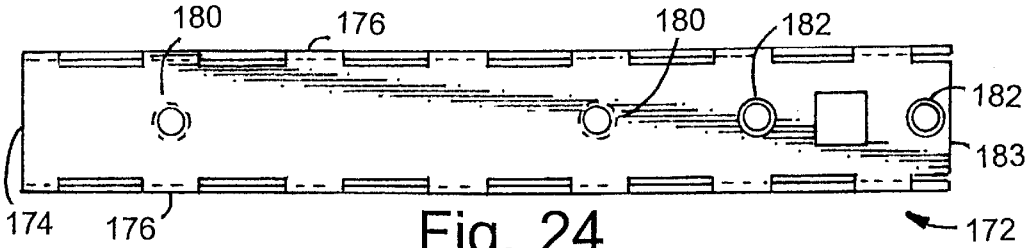
FIG. 24 is a plan view of an off-module connector rail.

A partition construction for sub-dividing a building workspace comprises a first panel 40 having a first panel frame 42 with a horizontal top frame member 44 and a vertical first side frame member 48 and a second panel 40 having a second panel frame 42 with a bottom horizontal frame member 46 and a vertical second side frame member 48, and wherein the first and second panels 40 are connected in a stacked arrangement to form a first partition stack 36. A connection system is utilized to stack panels 40 which includes at least one stacking connector 138 (FIG. 20) having fastener apertures 144 and 146 to interconnect vertically stacked panels 40. A horizontal rail 104 (FIG. 11) is disposed between vertically stacked panels 40 to vertically align top frame member 44 of the first panel 40 and bottom frame member 46 of the second panel 40. Partition stacks 36 may be comprised of one, two, three, or more panels 40 depending upon the desired height of partition stack 36. A partition stack 35 positioned intermediate ends 37 of partition stack 36 may be comprised of an equal number or fewer panels 40 than partition stack 36.

Each partition panel 40 includes a rectilinear frame 42 which, in turn, is constructed of a horizontal top frame member 44, a horizontal bottom frame 46, and vertical side frame members 48 which maintain frame members 44 and 46 in a parallel spaced apart relationship. Frame members 44–48 are adjoined at their respective ends to form rectilinear frame 42. The ends of frame members 44–48 are adjoined by gusset plates 50 at the respective corners of rectilinear frame 42 as described in greater detail herein. Completed rectilinear frame 42 also defines a central cavity 52. Partition panels 40 may be constructed of any desired length; however, in the preferred embodiment, panels 40 are constructed in substantially 4, 6, and 8 foot lengths.

Figure 5:
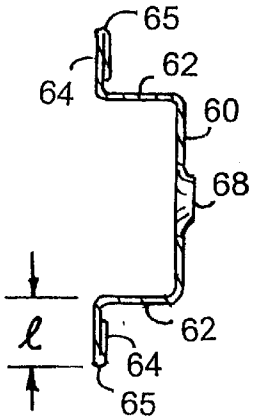
FIG. 5 is a cross-sectional view of the top frame member shown in FIG. 3.
Figure 9:
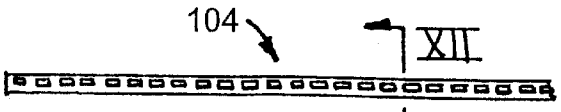
FIG. 9 is an exploded perspective view of a corner of the partition panel showing the partition panel construction.
Figure 9:
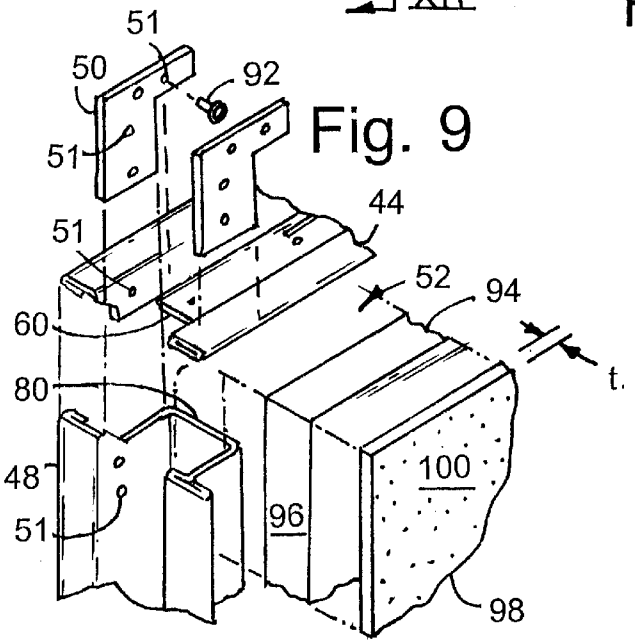

FIGS. 3–6 illustrate horizontal top frame member 44 (horizontal bottom frame member 46 being identical thereto) wherein frame member 44 is an elongate member having a generally U-shaped cross section as illustrated in FIG. 5. A web 60 forms a base of a channel 66 and supports legs 62 substantially perpendicular to web 60. Legs 62 have flanges 64 extending outwardly therefrom at an upper edge opposite web 60. Length "l" of flanges 64 is variable to accommodate side panels 98 (FIG. 9) such that edge 65 of flange 64 is substantially co-planar with surface 100 of panel 98 (FIG. 9). However, the overall width "w" of frame member 44 is maintained at a constant by correspondingly varying the width of web 60. In the present embodiment, width "w" is maintained at a dimension no greater than 2 inches, although other panel widths may be accommodated by the concepts of the present invention.

Figure 6:
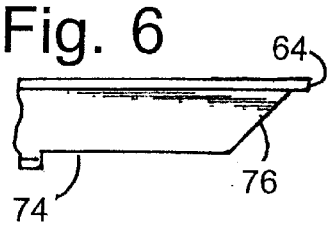
FIG. 6 is an enlarged elevational view of an end segment of the top frame member shown in FIG. 3.
Figure 4:
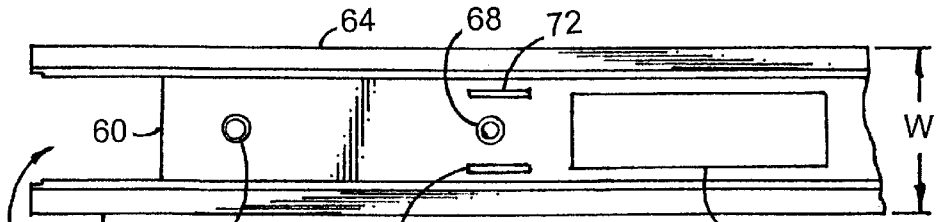
FIG. 4 is an enlarged plan view of an end segment of the top frame shown in FIG. 2.

Referring to FIG. 6, one end of frame member 44 is enlarged for greater detail to show a mitered area 76 of leg 62 and a relief portion 74 wherein web 60 is terminated short of the end of frame member 44. Mitered portion 76 and relief portion 74 are formed to accommodate the adjoining of vertical frame member 48. Referring now to FIG. 4, connector slots 72 are located in web 60, one slot being proximate to each of legs 62 and positioned a predefined distance from each end of frame member 44. The interaction of connector slots 72 with other components of partition construction 30 will be described in further detail herein. Clearance apertures 70 are positioned proximate each end of frame member 42 and at a central portion thereof to accommodate adjustable supports when frame member 42 is used as a bottom frame member 46.

Figure 7:
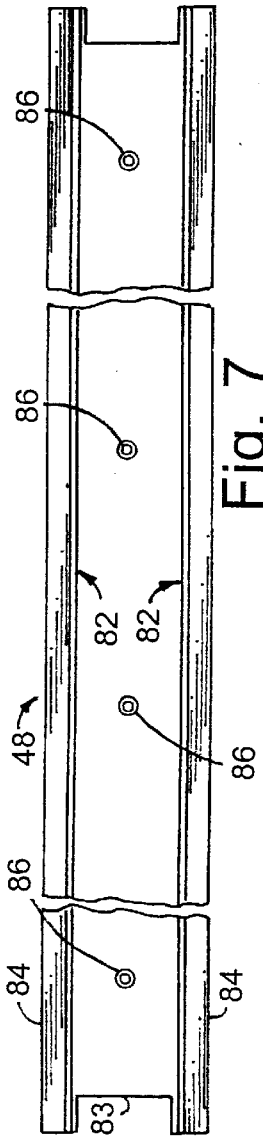
FIG. 7 is a plan view of a side frame member.
Figure 8:
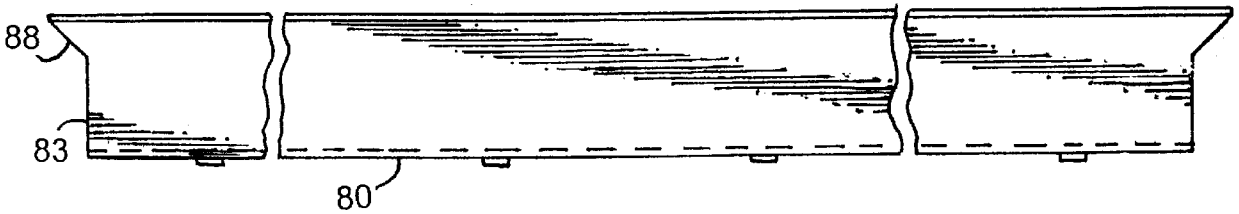
FIG. 8 is an elevational view of the side frame member shown in FIG. 7.

FIGS. 7–8 illustrate side frame member 48 wherein side frame member 48 has a U-shaped cross section similar to frame member 44, wherein side frame member 48 has web 80 supporting legs 82 which in turn have outwardly projecting flanges 84 at an opposite end of legs 82 from web 80. However, legs 82 of frame member 48 are substantially longer than legs 62 of frame member 44. Each end of frame member 48 has a mitered portion 88 of legs 82, and web 80 has a plurality of fastener apertures 86 centrally aligned therein and in the preferred embodiment comprise four fastener apertures.

As shown in FIG. 9, an exploded view of a corner construction of panel 40 is illustrated. When assembled to form rectilinear frame 42 the respective ends of frame members 44 and 48 are adjoined such that end edge area 83 of vertical frame member 48 substantially mates with relief area 74 of horizontal frame member 44 and mitered edge 88 of frame member 48 mates with mitered portion 76 of frame member 44. Frame members 44 and 48 are retained in a mating relationship by abutting corner gussets 50 to interior faces of legs 62 and 82 of frame members 44 and 48, respectively, and affixing gussets 50 thereto with fasteners 92 through fastener apertures 51, or alternatively spot welding gussets 50 to interior faces of legs 62 and 82.

Panel 40 is completed by inserting an acoustically dampening filler 94 in central cavity 52 and by affixing side panels 98 to frame 42 and filler 94. Side panels 98 may be of varying thickness "t," however, thickness "t" ideally corresponds to, but does not exceed, length "l" of flange 64 to provide a functional and aesthetically pleasing panel 40. Panel 98 may be constructed or fabricated of a wood paneling material, fiberglass over a wood paneling material, a vinyl or plastic panel, or, in one configuration, of gypsum board or STC. The utilization of gypsum board or STC for side panel 98 enhances the desired fire resistant property of partition panel 40 and is advantageous for that reason. When panel 98 is constructed of gypsum board, outer surface 100 may be covered with a cloth or cloth-like material for enhanced aesthetics. Side panel 98 is attached to an outer face of legs 62 and 82 of frame members 44 and 48. The U-shape of frame members 44 and 48 form frame channel 54 extending around the periphery of panel frame 42. Frame channel 54 is advantageous for allowing individual panels 40 to be closely adjoined to improve aesthetics while connecting elements such as in-line connector 154 and stacking connector 138 are disposed within frame channel 54 to interconnect individual panels 40 to form partition construction 30.

Figure 12:
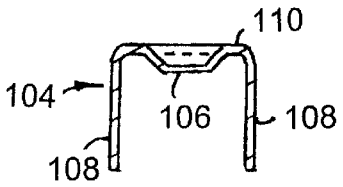
FIG. 12 is a cross-sectional view of the horizontal rail shown in FIG. 10.
Figure 2:
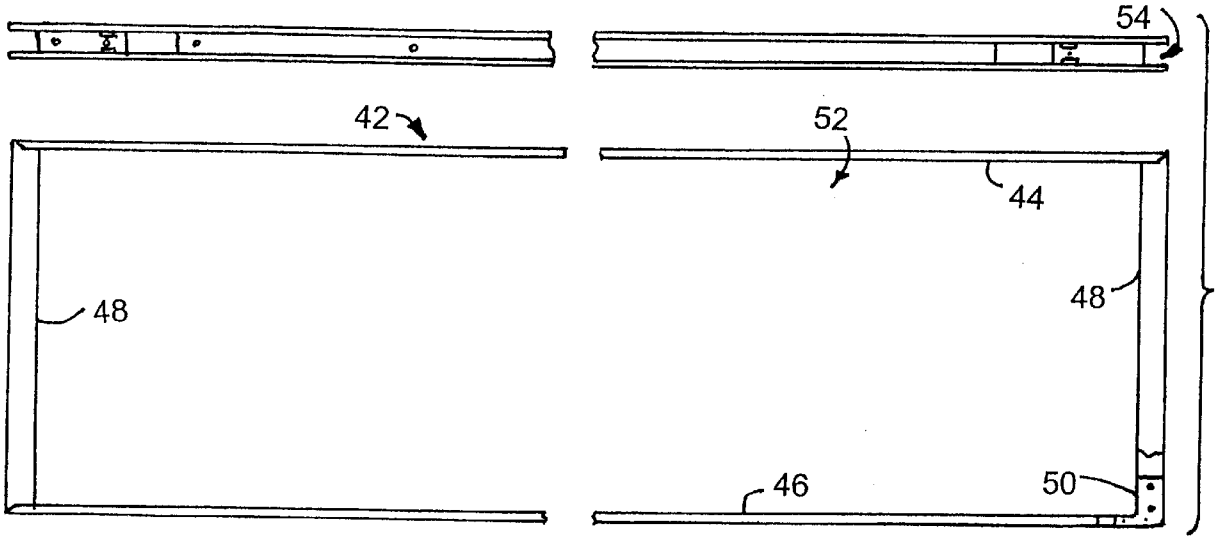
FIG. 2 is an elevational view of the partition panel frame.
Figure 13:
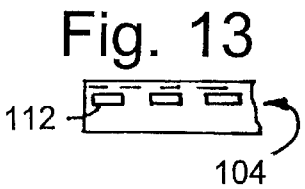
FIG. 13 is an enlarged elevational view of an end segment of the horizontal rail shown in FIG. 10.
Figure 3:
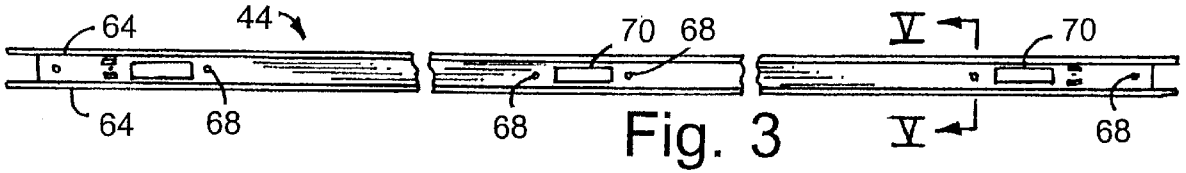
FIG. 3 is a plan view of the top of the frame shown in FIG. 2.
Figure 10:
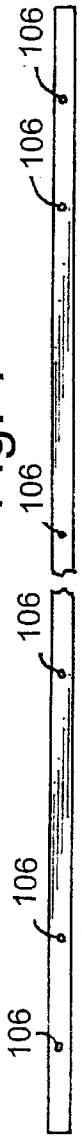
FIG. 10 is a plan view of a horizontal rail.
Figure 11:
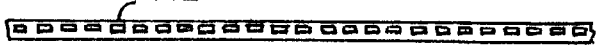
FIG. 11 an elevational view of the horizontal rail of FIG. 10.

FIGS. 10–12 illustrate horizontal channel 104. Horizontal channel 104 has a generally inverted U-shaped cross section as illustrated in FIG. 12 wherein horizontal rail 104 has an upper web 110 from which legs 108 thereby depend. The width of web 110 is typically slightly less than the width of frame channel 54 such that horizontal rail 104 may be closely received therein. Horizontal rail 104 has fastener apertures 106 in web 110 in a pattern which corresponds to fastener apertures 68 in frame member 44. Additionally, each of legs 108 have a plurality of horizontally oriented, in-line, regularly spaced slots 112 therethrough wherein slots 112 are positioned slightly below web 110 as shown in FIG. 13. In the preferred embodiment slots 112 are spaced at 1 inch increments, but can be spaced at other regular increments also.

Figures 21, 22, 25, 28:
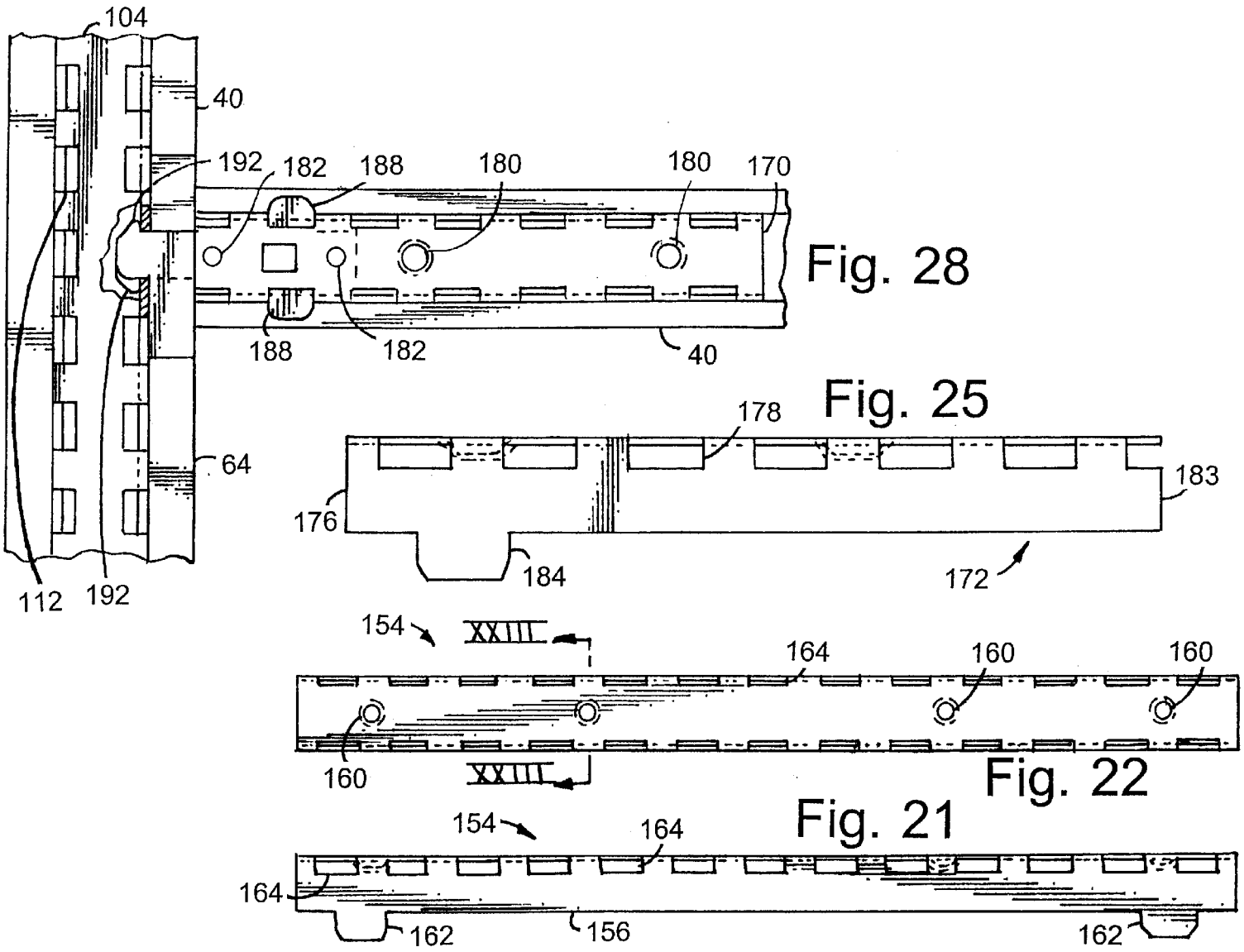
FIG. 21 is an elevational view of an in-line connector.
FIG. 22 is a plan view of the in-line connector shown in FIG. 21.
FIG. 25 is an elevational view of the off-module connector rail shown in FIG. 24.
FIG. 28 is a plan view of a partition panel connected to a second partition panel at an intermediate portion of the second panel utilizing the off-module connector.

Referring now to FIG. 14, horizontal rail 104 is shown partially disposed in frame channel 54 along an upper edge 41 of panel 40. As illustrated, in-line horizontally oriented slots 112 in horizontal rail 104 are exposed above top edge 41 for reasons to be specified herein. Horizontal rail 104 is provided in a variety of lengths to accommodate a variety of lengths of panels 40. Additionally, if horizontal rail 104 is disposed between two vertically adjacent panels 40, rail 104 will extend the entire horizontal length of frame channel 54. However, a somewhat shorter horizontal rail 104 is utilized at the top of the uppermost panel 40 in a partition stack 36 to accommodate the use of in-line connector 154 or off-module connector 170 (FIG. 28).

In partition construction 30, each of panels 40 has a horizontal rail 104 attached to a top edge 41 thereof with fasteners (not shown) engaging fastener apertures 106 and 68 of rail 104 and top frame member 44, respectively. When a second panel 40 is vertically stacked upon a first panel 40, a top portion of horizontal channel 104 is partially disposed within frame channel 54 at the bottom of second panel 40 thereby maintaining panels 40 in a vertically aligned relationship.

Figure 18:
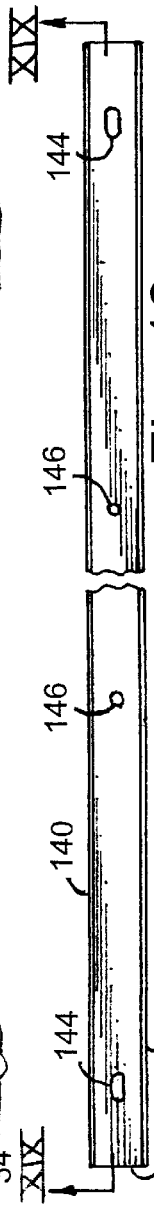
FIG. 18 is a plan view of a stacking connector.
Figure 19:
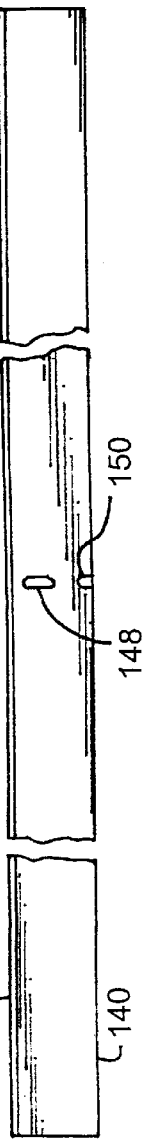
FIG. 19 is an elevational view of the stacking connector shown in FIG. 18.

When panels 40 are vertically stacked, the top edge 41 of the first panel 40 is spaced from the bottom edge of a second panel 40 such that slots 112 of horizontal rail 104 may be accessed by an installer of the partition construction 30 for the attachment of other panels 40 or partition panel stack 36 as further described herein. Stacking connector 138 as shown in FIGS. 18–19 is used to maintain panels 40 in their vertically stacked relationship. Stacking connector 138 is generally formed in a U-shape having a central web 142 with legs 140 depending therefrom. The height of legs 140 is less than the height of legs 82 of side frame member 48. Stacking connector 138 has a predefined pattern of aperture holes 146 and fastener slots 144 centrally located along web 142. The pattern of apertures 144 and 146 correspond to the fastener aperture pattern of fastener apertures 86 in web 80 of side frame member 48 such that when apertures 144 and 146 are aligned with fastener apertures 86 of vertically adjacent panels 40, panels 40 are vertically spaced to permit access to slots 112 in rail 104. Each of legs 140 at a midpoint along stacking connector 138 has a slot 48 and a partial slot 150 in-line with slot 148 therethrough. When stacking connector 138 is affixed to vertically adjacent panels 40, slots 148 and 150 correspond to the in-line horizontal slots 112 in horizontal rail 104.

To vertically stack two panels 40, a stacking connector 138 is nested within an upper portion of frame channel 54 of the first panel 40 and a portion of the lower frame channel 54 of a second panel 40 and is fastened to each panel 40 at each end thereof with fasteners engaging fastener apertures 144 and 146 in stacking connector 138 and fastener apertures 86 in side frame members 48 of each panel 40. When so engaged, slots 148 and 150 form a continuous line of slots with slots 112 in horizontal rails 104 such that there is a continuous line of like dimensioned, like spaced slots along in-line attached panels 40 or partition stacks 36.

Figure 23:
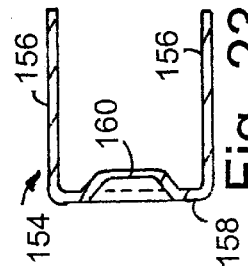
FIG. 23 is a cross-sectional view of the in-line connector of FIG. 21.
Figure 26:
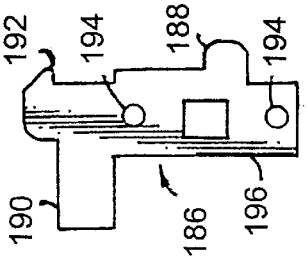
FIG. 26 is a plan view of an off-module connector plate.
Figure 27:
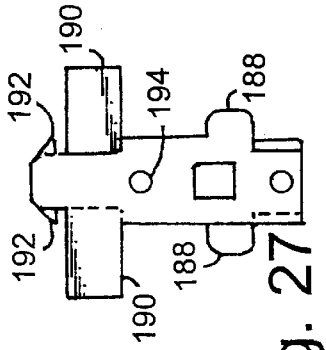
FIG. 27 is a plan view of an off-module connector plate stack showing two oppositely oriented off-module connector plates for engaging a slot in a horizontal rail.

In-line attachment of individual panels 40 or of partition stacks 36 is accomplished utilizing in-line connectors 154. In-line connector 154 is illustrated in FIGS. 21–23. A cross section of in-line connector 154 is similar to that of horizontal rail 104 wherein a central web 158 has legs 156 depending therefrom, the height of legs 156 corresponding to the height of legs 108 of horizontal rail 104 and the width of in-line connector 154 being slightly smaller than the width of frame channel 54 thereby permitting in-line connector 154 to be disposed therein. Each leg 156 has depending therefrom at a location proximate each end of connector 154 a connector tab 162, and a plurality of horizontally aligned regularly spaced slots 164 extend through legs 156 proximate to web 158. The size and spacing of slots 164 correspond to the size and regular spacing of slots 112 in horizontal rail 104.

Figure 30:
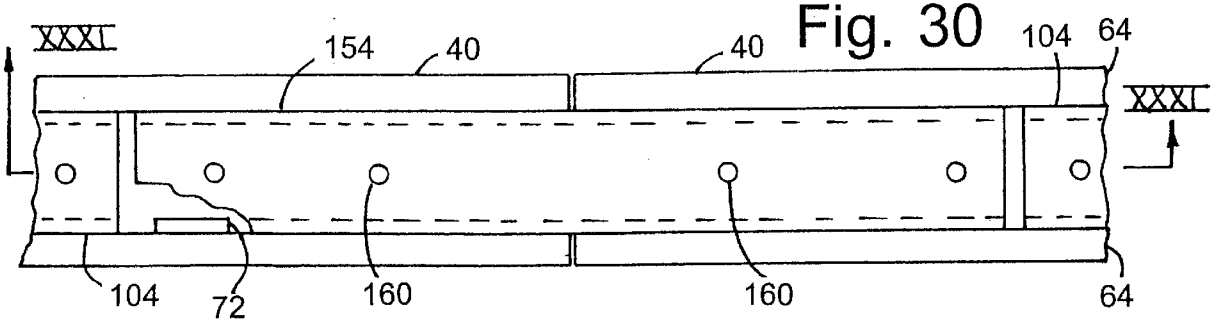
FIG. 30 is a plan view of adjoining ends of two in-line panels connected by an in-line connector.
Figure 31:
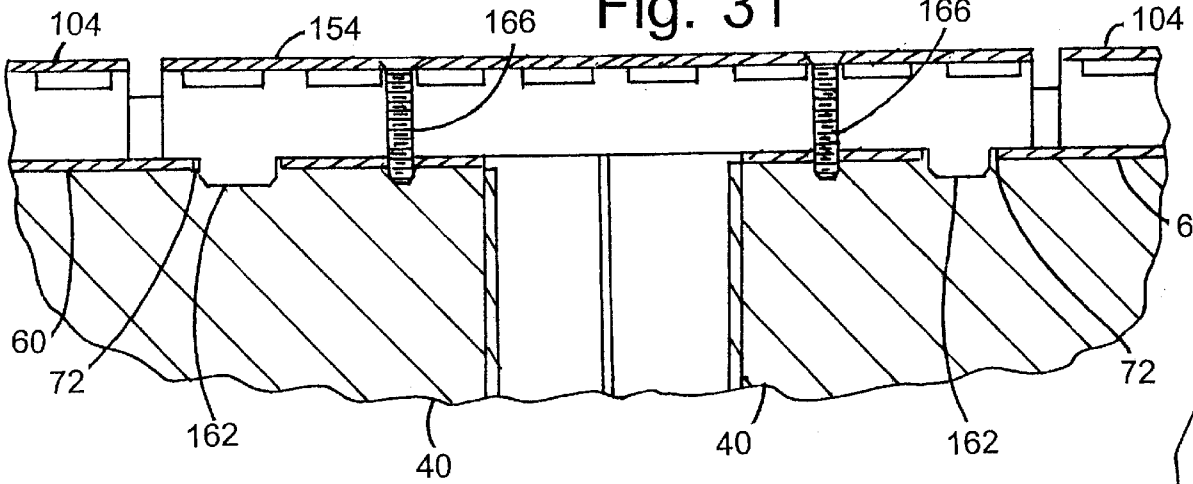
FIG. 31 is a sectional view of FIG. 30 showing the in-line connector engaged in the web of an upper frame member.

When joining two panels 40 or two partition stacks 36, panels 40 are placed in an end-to-end abutting relationship and in-line connector 154 is placed between the ends of horizontal rails 104 in frame channels 54 of the respective panels 40 such that tabs 162 at one end of connector 154 are closely received by slots 72 in one panel 40 and tabs 162 at the opposite end of connector 154 are closely received by slots 72 of the in-line adjoining panel 40 as shown in FIGS. 30 and 31. Fasteners 166 engage fastener apertures 160 in connector 154 and fastener apertures 68 of upper frame member 44.

Figure 32:
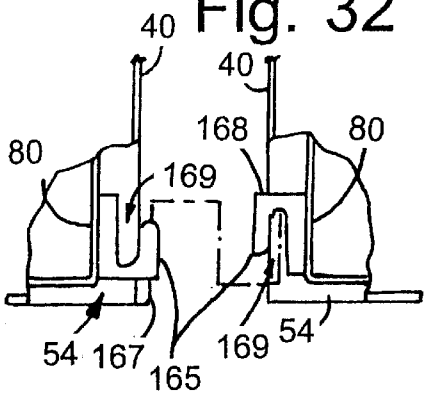
FIG. 32 is a partial sectional view of in-line connection of panels or partition stacks.

The bottoms of panels 40 or partition stacks 36 are connected in-line utilizing interengaging hook members 167 and 168 as illustrated in FIG. 32. One of panels 40 to be connected in-line has an upwardly oriented first interengaging hook member downwardly oriented and positioned at a lower portion of channel 54 and fastened to web 80. Hook member 167 has a slot 169 formed by leg 165. Hook member 168 is similarly fastened to web 80 of the other panel 40 with slot 169 and leg 165 downwardly oriented. In-line connection is accomplished by inserting legs 165 into the slots 169 of the mating hook members. Hook members 167 and 168 prevent longitudinal separation of in-line panels 40 while channel 54 maintains lateral alignment of the lower portions of panels 40.

Figure 15:
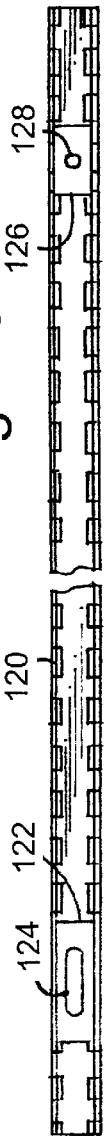
FIG. 15 is a plan view of a bottom channel adapted to receive adjustable feet for supporting a partition panel on a horizontal surface such as a floor.
Figure 16:
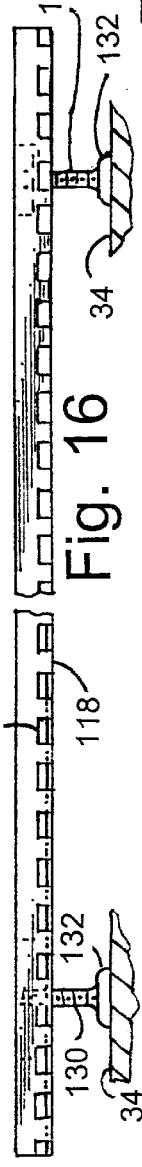
FIG. 16 is an elevational view of the bottom channel of FIG. 15 showing adjustable feet inserted therein and wherein such feet are resting on a horizontal surface.
Figure 17:
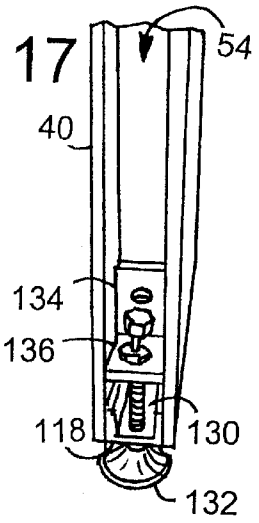
FIG. 17 illustrates an alternate embodiment for adjustable feet in the bottom of a partition panel.

The bottoms of panel 40 or partition stacks 36 typically do not rest directly on floor surface 34, but instead are supported above floor surface 34. A kickway channel 118 is used to provide such support on floor surface 34. As shown in FIGS. 15–16, kickway channel 118 is a U-shaped member having a like plurality of in-line horizontal slots as horizontal rail 104 and is likewise inserted and fastened within frame channel 54 at the bottom of the panel 40 most proximate to floor surface 34. Kickway channel 118 includes a first channel reinforcement 122 having a slotted aperture 124 therethrough and a second channel reinforcement 126 having a hole 128 therethrough. Reinforcements 122 and 126 are disposed within the U-shape of kickway channel 118 and are affixed to legs 119 therein. Reinforcements 122 and 126 provide support for threaded adjusting rod 130 having pivotal foot 132 affixed to one end thereof wherein foot 132 rests upon floor surface 34. Threaded adjusting rod is threadingly retained in aperture 124 and hole 128 in a manner which is well known in the art. A kickway cover panel (not shown) is used to aesthetically enclose the space between panel 40 and floor surface 34. An alternate embodiment illustrating a floor support positioned at and end of panel 40 is illustrated in FIG. 17. In this alternate embodiment, support bracket 134 is affixed within frame channel 54 to web 80 of frame member 48 in a manner such that threaded adjusting rod 130 extends through an end of kick channel 118 and horizontal leg 136 of bracket 134. In this embodiment, the adjustment of foot 132 with relationship to floor surface 34 is easily accomplished and is particularly adaptable where panel 40 has no additional panel in an in-line connected relationship thereto.

In addition to interconnecting panels 40 in a stacked or in-line configuration, one panel 40 may be connected to another panel 40 at an intermediate point therealong (off-module) and at right angles thereto or at the juncture of two in-line panels 40. Referring to FIGS. 24–28, a system for interconnecting one panel 40 to another at a point intermediate the ends of panel 40 is illustrated. An off-module connector 170 includes an off-module connector rail 172 having a central web 174 with sides 176 depending therefrom to form a U-shape cross section in like manner as horizontal rail 104 and in-line connector rail 154. Rail 172 also includes a plurality of horizontal in-line slots 178 through each of sides 176 and proximate to web 174. Slots 176 are sized and regularly spaced in a manner similar to horizontal slots 112 of horizontal rail 104. At one end of rail 172, each of sides 176 has a tab 184 depending therefrom and positioned in like manner as depending tabs 162 of in-line connector 154. However, off-module connector rail 172 is only one half the length of in-line connector 154 and with engagement of tabs 184 in slots 72 in frame channel 54, end 183 of rail 172 is substantially coincident with the vertical edge of panel 40. Web 174 also includes fastener apertures 180 extending therethrough and positioned in a central portion of web 174 to coincide with fastener apertures 68 in one end of upper frame member 44. Two additional fastener holes 182 are provided in web 174 proximate end 183 of rail 172 opposite the end where tabs 184 are positioned. An off-module connector plate 186 comprises the second element of off-module connector 170 wherein connector plate 186 generally comprises an elongate central body 196 having fastener holes 194 therethrough along a central axis of the long dimension of body 196. The width of central body 196 is dimensioned to nest within the U-shape of rail 172 and fastener holes 194 are dimensioned and spaced to correspond with fastener holes 182 in rail 172. Connector plate 186 has at one end thereof, a hook member 192 oriented to face one side of central body 196 and wherein an arm 190 extends laterally opposite the side oriented hook member 192. A tab 188 extends laterally from the same side of body 196 as hook member 192 and proximate to an opposite end of body 196 from hook member 192. Typically, off-module connector 170 utilizes two off-module connector plates 186 nested within the U-shaped cross section of rail 172, each of plates 186 oriented in opposite laterally facing directions and fastened to rail 172 in a stacked relationship with web 174 of rail 172.

To accomplish the off-module connecting of a first partition panel intermediate the ends of a second partition panel, a position intermediate the ends of the second partition panel to which the first partition panel 40 is to be attached is selected. The selected position corresponds to a slot 112 or 164 in the top edge 41 of the second partition panel 40. A tab 188 is engaged in a slot 178 of off-module connector rail 172 such that arm 190 is adjacent end 183 of rail 172 opposite tabs 184 and extends laterally therefrom. Body 196 of the first off-module connector plate 186 is abutted to web 174 of rail 172 and a tab 188 of a second off-module connector plate 186 is engaged in an oppositely oriented side slot 178 of rail 172 such that arm 190 of the second off-module connector plate 186 is also adjacent to end 183 of rail 172 and laterally extends in an opposite direction from arm 190 of the first connector plate 186. First and second hook members 192 of first and second connector plates 184 are engaged in the selected slot 112 or 164 along the top edge 41 of second partition panel 40. Each hook member 92 engages an opposite end of slot 112 or 164 and bears against an interior face of rail sides 156 or 108. First and second off-module connector plates are fastened to web 174 of connector rail 172 by aligning holes 182 and 194 and inserting fasteners (not shown) therein. Laterally extending arms 190 are vertically aligned with flange 64 of second partition panel 40. Off-module connector 170 extends perpendicularly from the selected intermediate position along second partition panel 40. First partition panel 40 is then aligned with and mated to off-module connector module 170 by disposing connector rail 172 within frame channel 54 of first partition panel 40 such that tabs 184 are closely received by slots 72 in web 60 of upper frame member 44. Fasteners such as fasteners 166 as shown in FIG. 31 are utilized to fasten connector 170 to first partition panel 40 through apertures 180 and 68. If desired, and as utilized in the preferred embodiment, a like off-module connector 170 can be utilized in like manner to affix a bottom edge of partition panel 40 at a like intermediate position of the second partition panel 40 by engaging slots 164 or slots 120 of in-line connector 154 or channel 118.

In use, partition construction 30 may be arranged in a variety of configurations of partition panels 40. Panels 40 may be arranged in a stacked relationship forming partition stacks 36 of multiple partition panels 40 and wherein like partition panels 40 or partition stacks 36 may be interconnected in an in-line configuration utilizing stacking connectors 138 or in-line connectors 154 as described above. The addition of additional panels 40 or partition stacks 36 at right angles to either a single length partition panel 40 or an in-line connected series of panels 40 is accomplished by utilizing off-module connector 170 as described above. Alternatively, panels 40 may be connected to other in-line connected panels 40 or to partition stacks 36 utilizing off-module connector 170 by engaging a slot 154 in an in-line connector or at an intermediate height of a partition stack 36 by engaging a slot 148 or a slot 150 of two mutually facing stacking connectors. Unmated top and end edges are covered by aesthetic covers in a manner well known in the art.

Figure 29:
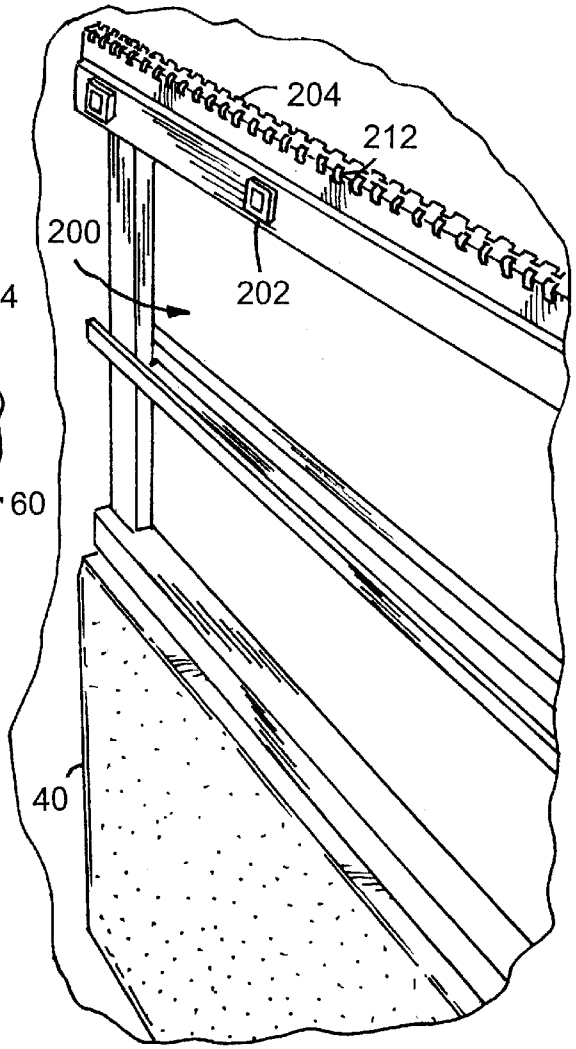
FIG. 29 is a perspective view of an optional utility raceway which may be incorporated in place of one of the partition panels and utilized to route various office utilities throughout the office area.

Referring to FIG. 29, an optional beltway 200 may be included above a partition panel 40 or alternatively between two vertically stacked partition panels 40 to provide a space for the routing of electrical or data communication cabling or other office utilities wherein beltway 200 includes utility outlets 202 spaced therealong and also includes a top rail 204 having slots 212 therealong in a manner similar to rail 104 and slots 112 therein to facilitate the stacking or off-module connection of other panels 40.

In the foregoing description, it will be readily appreciated by those skilled in the art that modifications may be made to the invention without departing from the concepts disclosed herein. Such modifications are to be considered as included in the following claims, unless these claims expressly state otherwise.

The embodiments of the invention in which an exclusive property or privilege is claimed are defined as follows:

1. A partition construction for subdividing a building work space, comprising:

a first panel having a first frame comprising at least a horizontal top frame member and a vertical first side frame member;

a second panel having a second frame comprising at least a horizontal bottom frame member and a vertical second side frame member; and a connection system connecting said first and second panels in a stacked arrangement to form a first partition stack wherein each of said first and second side frame members has fastener apertures in a predefined pattern, and comprising:

at least one stacking connector having, proximate to each end thereof, fastener apertures in a like predefined pattern; and a first horizontal rail vertically aligning said top frame member and said bottom frame member.

2. The partition construction as set forth in claim 1 wherein said horizontal top frame member and said horizontal bottom frame member have a U-shaped cross section and define respectively a first frame channel and a second frame channel.

3. The partition construction as set forth in claim 2 wherein said first horizontal rail is at least partially disposed in said first frame channel of said horizontal top frame member and at least partially disposed in said second frame channel of said horizontal bottom frame member.

4. The partition construction as set forth in claim 3 wherein said first horizontal rail comprises two sides, a web connecting said two sides, and each of said sides having a plurality of in-line, horizontally oriented slots positioned such that said slots are accessible to an installer when said first horizontal rail is disposed within said first and said second frame channels, said slots positioned at regularly spaced intervals along said first horizontal rail.

5. The partition construction as set forth in claim 4 further comprising:

at least a third panel substantially identical to said first and said second panels; and a first off-module connector connecting said third panel to said first partition stack at substantially a right angle and positionable at a plurality of discreet regularly spaced intervals along an intermediate portion of said first partition stack.

6. The partition construction as set forth in claim 5 wherein said plurality of regularly spaced intervals corresponds to said regularly spaced intervals of said slots in said first horizontal rail.

7. The partition construction as set forth in claim 6 wherein said off-module connector comprises:

an off-module connector rail having two sides and a connecting member, each of said sides having a plurality of horizontally oriented slots spaced at regular intervals therealong said intervals substantially the same as said intervals of said first horizontal rail; and at least a first off-module connector plate nested between said two sides, said first off-module connector plate having a first tab engaging at least one of said slots in one side of said off-module connector rail and a first hook member engaging an end of one of said slots in said first horizontal rail.

8. The partition construction of claim 7 wherein said off-module connector further comprises a second off-module connector plate nested between said two sides and abutting said first off-module connector plate and substantially identical to said first off-module connector plate, said second off-module connector plate having a second tab engaging one of said slots in an other side of said off-module connector rail and a second hook member engaging an other end of said one of said slots in said first horizontal rail.

9. The partition construction of claim 8 wherein said off-module connector attaches a top of said third panel to said first horizontal rail, said partition construction further comprising:

a second horizontal rail having horizontally oriented slots therealong, said slots substantially vertically aligned with said slots in said first horizontal rail and wherein said second horizontal rail is disposed within a frame channel of said partition stack corresponding to a bottom of said third panel; and a second off-module connector substantially identical to said first off-module connector attaching a bottom of said third panel to said second horizontal rail.

10. The partition construction of claim 1 further comprising:

a second partition stack substantially identical to said first partition stack, each of said first and said second partition stacks respectively having a first top partition channel and a second top partition channel, said channels having at least one slot in a bottom thereof proximate to each end of said first and said second top partition channels;

a first upper horizontal rail disposed within said first top partition channel and a second upper horizontal rail disposed within said second top partition channel, said first and said second upper horizontal rails being shorter than each of said first and said second partition stacks; and a first horizontal connector rail connecting said first and said second partition stacks in an end-to-end in-line relationship, said horizontal connector rail including at least a first depending tab at a first end thereof engaging said at least one slot in said bottom of said first top partition channel and a second depending tab at a second end thereof engaging said at least one slot in said bottom of said second top partition channel.

11. The partition construction of claim 10 wherein said first and said second partition stacks further include respectively, a first and second bottom partition channel, said channels having at least one slot in a bottom thereof proximate to each end of said first and said second bottom partition channels, and wherein said partition construction further comprises:

a first bottom horizontal rail disposed within said first bottom partition channel and a second bottom horizontal rail disposed within said second bottom partition channel, said first and said second bottom horizontal rails being shorter than a length of each of said first and said second partition stacks; and a second horizontal connector rail connecting said first and said second partition stacks in an end-to-end in-line relationship, said second horizontal connector rail including at least a first depending tab at a first end thereof engaging said at least one slot in said bottom of said first bottom partition channel and a second depending tab at a second end thereof engaging said at least one slot in said bottom of said second bottom partition channel.

12. The partition construction as set forth in claim 1 wherein each of said panels comprises:

a frame further comprising two vertical side frame members, a horizontal top frame member, and a horizontal bottom frame member, said frame members joined at their respective ends to form a rectilinear frame defining a central cavity;

an acoustically damping filler disposed within said central cavity; and a side panel affixed to each of said first and second frame sides enclosing said central cavity.

13. The partition construction as set forth in claim 12 wherein said side panels are at least partially constructed of gypsum board.

14. The partition construction of claim 1 further comprising:

a second partition stack substantially identical to said first partition stack, each of said first and said second partition stacks respectively having a first top partition channel and a second top partition channel, said channels having at least one slot in a bottom thereof proximate to each end of said first and said second top partition channels;

a first upper horizontal rail disposed within said first top partition channel and a second upper horizontal rail disposed within said second top partition channel, said first and said second upper horizontal rails having a length shorter than a horizontal length of each of said first and said second partition stacks; and a first horizontal connector rail connecting said first and said second partition stacks in an end-to-end in-line relationship, said horizontal connector rail including at least a first depending tab at a first end thereof engaging said at least one slot in said bottom of said first top partition channel and a second depending tab at a second end thereof engaging said at least one slot in said bottom of said second top partition channel.

15. The partition construction of claim 14 wherein said first and said second partition stacks further include respectively, a first and second bottom partition channel, said channels having at least one slot in a bottom thereof proximate to each end of said first and said second bottom partition channels, and wherein said partition construction further comprises:

a first bottom horizontal rail disposed within said first bottom partition channel and a second bottom horizontal rail disposed within said second bottom partition channel, said first and said second bottom horizontal rails having a length shorter than a horizontal length of each of said first and said second partition stacks; and a second horizontal connector rail connecting said first and said second partition stacks in an end-to-end in-line relationship, said second horizontal connector rail including at least a first depending tab at a first end thereof engaging said at least one slot in said bottom of said first bottom partition channel and a second depending tab at a second end thereof engaging said at least one slot in said bottom of said second bottom partition channel.

16. The partition construction as set forth in claim 1 wherein said first and said second panels include a top edge having a plurality of in-line, horizontally oriented sideward facing slots.

17. The partition construction as set forth in claim 16 further comprising:

at least a third panel substantially identical to said first and said second panels; and a first off-module connector connecting said third panel to said first partition stack at substantially a right angle and positionable at a plurality of discreet regularly spaced intervals along an intermediate portion of said first partition stack.

18. The partition construction as set forth in claim 17 wherein said plurality of regularly spaced intervals corresponds to said regularly spaced intervals of said slots in said top edge of said panels.

19. The partition construction as set forth in claim 18 wherein said off-module connector comprises:

an off-module connector rail having two sides and a connecting member, each of said sides having a plurality of horizontally oriented slots spaced at regular intervals therealong said intervals substantially the same as said intervals of said slots in said top edge of said panel; and at least a first off-module connector plate nested between said two sides, said first off-module connector plate having a first tab engaging at least one of said slots in one side of said off-module connector rail and a first hook member engaging an end of one of said slots in said top edge of said panel.

20. The partition construction of claim 19 wherein said off-module connector further comprises a second off-module connector plate nested between said two sides and abutting said first off-module connector plate and substantially identical to said first off-module connector plate, said second off-module connector plate having a second tab engaging one of said slots in an other side of said off-module connector rail and a second hook member for engaging an other end of said one of said slots in said top edge of said panel.

21. The partition construction of claim 20 wherein said off-module connector attaches a top of said third panel to said top edge of said first panel and wherein said first partition panel includes a bottom edge having a like plurality of in-line, horizontally oriented sideward facing slots as said top edge, said partition construction further comprising a second off-module connector substantially identical to said first off-module connector attaching a bottom edge of said third panel to said bottom edge of said first panel.

22. A partition construction for subdividing a building work space, comprising:

a plurality of substantially identical panels selectively interconnectable in a stacked arrangement, in an in-line arrangement, and in combined stacked and in-line arrangements, each of said panels having a rectilinear frame comprising at least a horizontal top frame member, a horizontal bottom frame member, and vertical side frame members maintaining said top and said bottom frame members in a parallel spaced apart relationship and defining a central cavity, said frame members having a predefined pattern of fastener apertures therethrough;

a plurality of horizontal rails, each of said horizontal rails positioned proximate said top frame member of each of said plurality of panels, and each of said horizontal rails having a repeating pattern of horizontally aligned slots therealong;

at least one stacking connector having, proximate to each end thereof, fastener apertures in a predefined pattern substantially identical to a portion of said frame member fastener pattern; and at least one horizontal connector rail connecting said panels in an in-line arrangement, said horizontal connector rail having, proximate to each end thereof, fastener apertures in a predefined pattern substantially identical to a portion of said frame member fastener pattern.

23. The partition construction as set forth in claim 22 wherein said frame members have a U-shaped cross section and define a frame channel around each of said frames.

24. The partition construction as set forth in claim 23 wherein said horizontal rails are at least partially disposed in a frame channel at a top of a first panel and at least partially disposed in a frame channel at a bottom of a second panel.

25. The partition construction as set forth in claim 24 wherein each of said horizontal rails comprises two sides, a web connecting said two sides, and each of said sides having a plurality of in-line, horizontally oriented slots positioned therein such that said slots are accessible to an installer when said horizontal rail is disposed within said frame channels of said first panel and said second panel, said slots positioned at regularly spaced intervals along said each of said horizontal rails.

26. The partition construction as set forth in claim 25 further comprising:

at least one off-module connector connecting a third panel to said first panel at substantially a right angle and positionable at a plurality of discreet, regularly spaced intervals along an intermediate portion of said first panel.

27. The partition construction as set forth in claim 26 wherein said plurality of regularly spaced intervals corresponds to said regularly spaced intervals of said slots in each of said horizontal rails.

28. The partition construction as set forth in claim 27 wherein said off-module connector comprises:

an off-module connector rail having two sides and a web member connecting said two sides, each of said sides having a plurality of horizontally oriented slots spaced at regular intervals therealong said intervals substantially the same as said intervals of each of said horizontal rails; and at least a first off-module connector plate nested between said two sides and abutting said web member, said first off-module connector plate having a first tab engaging at least one of said slots in one side of said off-module connector rail and a first hook member engaging an end of one of said slots in said horizontal rail.

29. The partition construction of claim 28 wherein said off-module connector further comprises a second off-module connector plate nested between said two sides and abutting said first off-module connector plate and substantially identical to said first off-module connector plate, said second off-module connector plate having a second tab engaging one of said slots in an other side of said off-module connector rail and a second hook member engaging an other end of said one of said slots in said horizontal rail.

30. The partition construction of claim 29 wherein said off-module connector attaches a top of said third panel to said horizontal rail, said partition construction further comprising:

a bottom horizontal rail having horizontally oriented slots therealong, said slots substantially vertically aligned with said slots in said horizontal rail and wherein said bottom horizontal rail is disposed within a frame channel of said partition stack corresponding to a bottom of said third panel; and a second off-module connector substantially identical to said first off-module connector for attaching a bottom of said third panel to said second horizontal rail.

31. The partition construction as set forth in claim 22 wherein each of said panels further comprises:

a first side and a second side;

an acoustically damping filler disposed within said central cavity; and a side panel affixed to each of said first and second frame sides and extending substantially a length and width of said each of said frame sides.

32. The partition construction as set forth in claim 31 wherein said side panels are at least partially constructed of gypsum board.

33. An off-module connector connecting office partition panels in a substantially perpendicular fashion wherein a first partition panel is positioned intermediate ends of a second partition panel, each of the partition panels having at a top edge thereof at least one upwardly facing connector slot and a series of horizontal sideward facing slots arranged in a linear, regularly spaced pattern, said off-module connector comprising:

an off-module connector rail having two sides and a web member connecting said two sides, each of said sides having a plurality of horizontally oriented slots spaced at regular intervals therealong, said intervals substantially the same as the linear, regularly spaced pattern of the horizontal sideward facing slots along the top edge of the partition panel; and at least a first off-module connector plate nested between said two sides and abutting said web member, said first off-module connector plate having a first tab engaging at least one of said slots in one side of said off-module connector rail and a first hook member engaging an end of one of the horizontal sideward facing slots in the top edge of the second partition panel.

34. The off-module connector of claim 33 further comprising a second off-module connector plate nested between said two sides and abutting said first off-module connector plate and substantially identical to said first off-module connector plate, said second off-module connector plate having a second tab engaging one of said slots in an other side of said off-module connector rail and a second hook member engaging an other end of one of the slots in the top edge of the second partition panel.

35. The off-module connector of claim 34 further wherein said off-module connector rail includes at least one connector tab depending from a bottom of one of said sides thereof, said connector tab positioned to engage the upwardly facing connector slot in the top edge of the first partition panel.

36. The method of connecting a first partition panel intermediate ends of a second partition panel wherein each of said panels has a plurality of in-line slots positioned at a top edge of each of said panels, said top panel edges also defining a channel therebetween, the method comprising the steps of:

selecting a position for said first partition panel intermediate said ends of said second partition panel and corresponding to a slot in said top edge of said second partition panel;

engaging a first tab of a first off-module connector plate in a side slot in a first side of an off-module connector rail;

abutting said first off-module connector plate to a web of said off-module connector rail;

engaging a second tab of a second off-module connector plate in an oppositely oriented side slot in a second side of said off-module connector rail;

abutting said second off-module connector plate to said first off-module connector plate;

engaging a first hook member of said first off-module connector plate in an end of one of said slots in said top edge of said second partition panel;

engaging a second hook member of said second off-module connector plate in an other end of said one of said slots in said top edge of said second partition panel;

fastening said first and said second off-module connector plates to said web of said off-module connector rail;

positioning said first partition panel at said position intermediate said ends of said second partition panel; and fastening said off-module connector rail to said top of said first partition panel.

* * * * *